United States Patent [19]

Clumb

[11] Patent Number: 4,899,919

[45] Date of Patent: Feb. 13, 1990

[54] SELF ENERGIZING FASTENER SYSTEM

[76] Inventor: Thomas E. Clumb, 5505 N. Illinois, Indianapolis, Ind. 46208

[21] Appl. No.: 176,449

[22] Filed: Apr. 1, 1988

[51] Int. Cl.[4] ..... B25C 1/10

[52] U.S. Cl. ..... 227/9; 411/441

[58] Field of Search ..... 227/8-10; 411/440, 441

[56] References Cited

U.S. PATENT DOCUMENTS

| | | | |
|---|---|---|---|
| 2,400,878 | 5/1946 | Dunn | 411/440 |
| 2,663,259 | 12/1953 | Catlin et al. | 411/440 |
| 2,954,717 | 10/1960 | Henning et al. | 411/440 |
| 3,097,602 | 7/1963 | Turner | 227/9 |
| 3,200,706 | 8/1965 | Kinard | 411/441 X |
| 3,398,684 | 8/1968 | Kvavle | 227/9 |
| 3,797,721 | 3/1974 | Clumb | 227/9 |

*Primary Examiner*—Frank T. Yost
*Assistant Examiner*—Rinaldi Rada
*Attorney, Agent, or Firm*—Leo J. Aubel

[57] ABSTRACT

A fastening system including a tool for initiating energizing of a fastener into a material such as concrete wherein the fastener and an energizing medium or propellant are initially affixed to one another, and wherein the tool includes a means for venting the propellant energy when the associated fastener has penetrated the material to a selected depth.

3 Claims, 1 Drawing Sheet

SELF ENERGIZING FASTENER SYSTEM

DESCRIPTION

BACKGROUND OF THE INVENTION

The present invention relates to a fastening system comprising a self energizing fastening element or fastener and a tool for initiating energization of the fastening element. The tool also provides means for assuring the fastening element is driven or inserted a controlled amount to a predetermined depth.

More particularly, the present invention relates to improvements in propellant actuated tools of the type described and claimed in U.S. Pat. No. 3,797,721 granted on Mar. 19, 1974. As is now well known and as described in the aforesaid patent, propellant actuated tools function to drive a fastener or fastening element into a work piece by the expanding gases produced by an associated propellant charge which is ignited by impact of an actuating member against the charge.

The inventive system includes a self energizing fastener which is utilized in connection with a tool to activate the self energizing fastener. The tool includes a barrel having a bore or fastener holding chamber terminating in an open end. The bore is shaped to receive and position the fastener. The fastener has a percussion activatable propellant charge which is energized by the impact received from an activating member positioned in the bore. The bore is formed to be of a length that is such that a portion of the fastener extends outwardly of the bore beyond the end of the barrel. More specifically, in operation the tip end of the fastener extends outwardly from the tool; and, striking the tip end of the fastener against the work surface into which it is to be driven, enables the activating member to initiate the energization of the propellant to drive the fastener into the desired work surface.

The present inventive system also provides a tool and fastener system that is efficient, reliable, safe, and troublefree.

SUMMARY OF INVENTION

In accordance with the present invention a system is disclosed for driving a fastening element by a propellant charge. The tool comprises a barrel having a bore therein for positioning a fastening element to be activated by the tool. The bore is adapted for receiving the fastener which has a percussion activatable or ignitable propellant charge affixed thereto. When the propellant is activated or ignited the fastener is driven from the tool into the selected surface.

A closed gas expansion chamber surrounds the barrel and communicates with the bore through one or more passageways in the barrel directly adjacent the end or muzzle of the tool. Importantly, the passageways are positioned in a location at the end of the muzzle to selectively vent the fastener holding chamber, as will be explained. When the fastener moves and is inserted into the material, and as the head or large end of the fastener moves past the passageways, the passageways will vent or provide an exit means for the expanding gases of the propellant thereby causing the pressure or force being applied on the fastener to drop.

The penetration of the fastener into the work surface is thus controlled. The foregoing protects against driving the fastener into the work surface further than required. Accordingly, the same type of fastener and charge may be used safely and efficiently in a range of different densities and compressive strengths of concrete.

BRIEF DESCRIPTION OF THE DRAWINGS

Novel features and advantages of the present invention in addition to those mentioned above will become apparent to those skilled in the art from a reading of the following detailed description in conjunction with the accompanying drawing wherein.

DETAILED DESCRIPTION OF THE INVENTION

Figure 1:
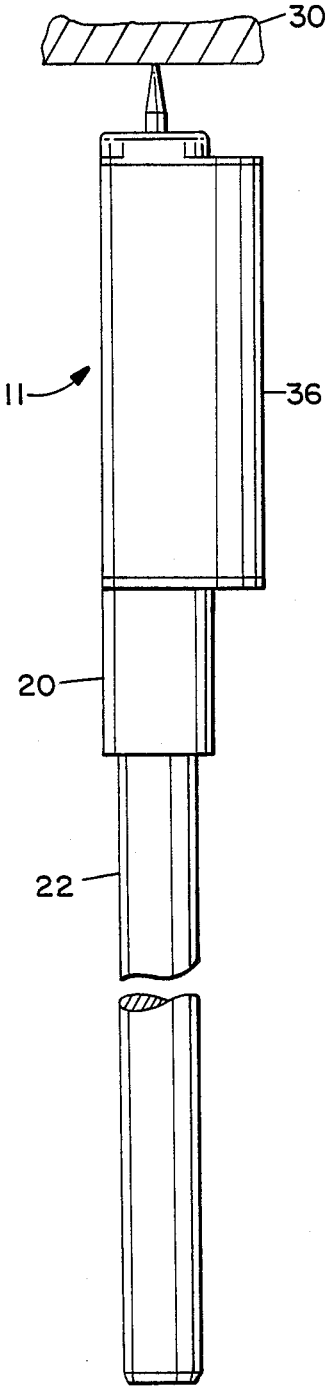
FIG. 1 is an elevational view of self energizing system in accordance with the present invention.
Figure 2:
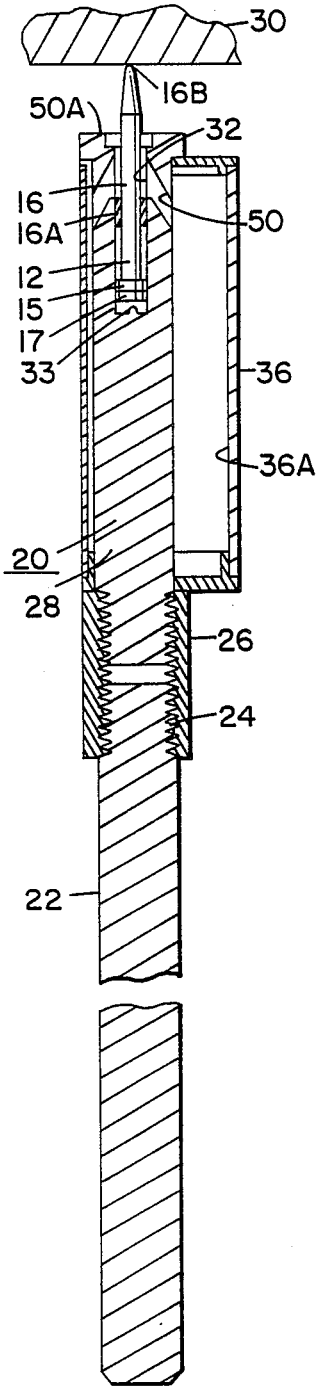
FIG. 2 is a cross section view of FIG. 1.

In accordance with FIGS. 1 and 2, a fastening system 11 comprises a fastener assembly 10 including a fastener 12 such as a nail, stud, screw, etc. with a head portion 15 and a body or shank portion 16. A charge pellet 17 is attached to the fastener 12, as will be explained. A plastic fluted centering member, 16A is positioned around shank 16, as is well known in the art. The fastening system 11 further includes a setting or driving tool 20, as will be explained.

Figure 3:
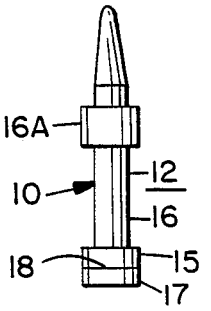
FIG. 3 is a view of the self energizing fastener assembly.
Figure 3A:
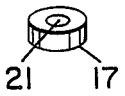
FIG. 3A is an isometric view of the pellet of the fastener assembly.
Figure 4:
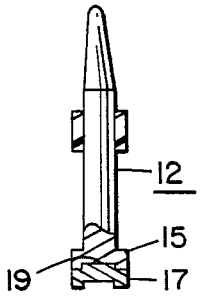
FIG. 4 is another embodiment of the fastener of FIG. 3.
Figure 5:
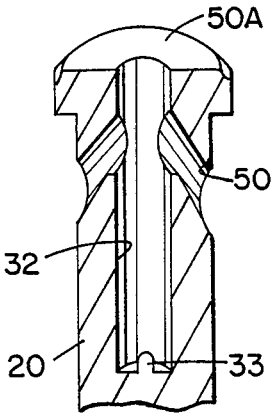
FIG. 5 is an isometric view partially in section of the bore or fastener holding assembly of FIGS 1 and 2.

As best seen in FIG. 3, the pellet 17 comprises a cylindrical body of a compaction of propellant powder. Pellet 17 may be formed with a top cavity to receive a primer composition 21 which will cause deflagration of the charge pellet 17 when the primer 21 is ignited. Importantly, the charge pellet 17 is affixed such as by adhesive 18 to the head 15 of fastener 12. The pellet 17 may also be formed as by inserting a pellet, or powder of a pellet into a suitable cavity 19 formed in the head 15 of fastener as indicated in FIG. 4. In another embodiment the pellet is formed of nitrocellulose such as shown in U.S. Pat. No. 3,372,643, and in such case the nitrocellulose is self igniting in response to friction or pressure, and a primer is not required.

Setting tool 20 includes an elongated extension handle 22. Handle 22 includes a threaded end section 24 which screws into one end of cylindrically shaped coupler 26. The other end of coupler 26 is threaded into one end of a barrel 28.

The other or free end of barrel 28 includes a longitudinal bore or chamber 32 adapted to receive the fastener assembly 10. The head 15 of fastener 12 is in cylindrically sealing relation with the circumference of bore 32. For operation the tip or free end 16B of shank 16 of fastener 12 extends outwardly of the end of bore 32.

An expansion chamber 36 forms an enlarged enclosed cavity 36A for receiving the expanding gases created by the propellant charge pellet 17. Chamber 36 is formed around barrel 28 adjacent bore 32. A function of the expansion chamber is described in U.S. Pat. No. 3,797,721 issued to the same inventor as in the present application.

An activating or igniting projection 33 is formed in the inner axial end of bore 32. The projection or striker 33 may be located in the axial center, or to one side of the end of the chamber to accommodate the primer 21. The projection 33 is located to impinge on or engage the end of pellet 17 at the area or place where the primer 21 is located. If no primer is used in pellet 17 the projection 33 strikes the end of the pellet 17.

Importantly, the construction of the tool 20 is provided to assure safe activation of the fastener 12 having the propellant charge affixed to the fastener 12. A significant advantage of the tool 20 is that it accommodates a total unit, that is, a fastener 12 with the propellant 17 already affixed thereto. Thus the total propellant means for driving the fastener 12 and the fastener itself comprise a single unit fastener assembly 10.

For operation the fastener assembly 10 is positioned into the tool 20 by inserting the assembly 10 into the bore 32 as shown in FIG. 2. This eliminates an entire positioning step; that is, the positioning operation consists of inserting a single composite unit rather than two separate units; that is, there is no need to insert a fastener in one step and insert a separate propellant as another step.

Also important is the feature that tool 20 provides venting apertures or passageways 50 adjacent the muzzle end 50A of bore 32 thereby permitting fasteners of different lengths and different propellant charges to be utilized to penetrate different materials or workpieces generally indicated as 30. For example, a fastener with a more powerful charge will not necessarily drive a fastener through a material or workpiece 30 having a regular charge affixed thereto. This is due to the fact that as soon as the head of the fastener 12 is driven by the expanding gases of the propellant to move past the venting apertures or passageways 50, the expanding gases will vent outwardly into the expansion chamber 36 and thereby relieve the pressure driving the fastener 12 and the fastener will not be driven further into the material. Thus the fasteners will be driven through the workpiece 30 to a point determined by the position and size of the venting apertures 50 and not be the differences in the propellant charge.

Further, the tool 20 provides an inherently safe structure. The reason for the foregoing is that the workpiece 30 against which the fastener 12 is positioned functions as the anvil or pressure base against which the fastener 12 impinges to cause the propellant 17 to be ignited or activated by the projection 33. Note that the top end or tip 16B of shank 16 of fastener 12 extends outwardly beyond the muzzle end 50A of bore 32. The tool 20 is operated by striking the tip 16B against the workpiece 30. The force of the impact of tip 16B against the workpiece 30 will drive the head 15 of fastener 12 and pellet 17 against projection or striker 33 to cause the pellet to deflagrate and drive fastener 12 into the workpiece 30. The tool 20 will activate the propellant 17 of fastener 12 only when the tip 16B is positioned against or comes into contact with the workpiece 30, for example, such as shown in FIGS. 1 and 2. If the fastener 12 is not positioned against the material or workpiece 30 that provides the anvil or base support, the propellant 17 will not ignite and activate the propellant forces.

It will be appreciated that in another embodiment, a projection as 33 can be formed on the head 15 of fastener 12, rather than in bore 32 of tool 20, to provide the localized striking force.

While the invention has been particularly shown and described with reference to a preferred embodiment thereof, it will be understood by those skilled in the art that various changes in form and details may be made therein without departing from the spirit and scope of the invention.

I claim:

1. A fastener assembly comprising a fastener having a shaft portion, and a head portion of relatively larger diameter than said shaft portion, said head portion having a surface contiguous to said shaft portion and a free surface remote from said shaft portion, and a deflagratable propellant pellet comprising a cylindrical body of substantially the same diameter as said head portion, said body having a first or affixing surface and a second or impact surface, said first surface, of said pellet being affixed to said free surface of head portion, said body of said pellet extending axially from said head portion and affixed to said free surface of said head portion thereby forming a unitary fastener assembly.

2. An assembly as in claim 1 wherein said free surface of said head portion is relatively planar, and said assembly includes adhesive means for affixing said pellet to said free surface.

3. An assembly as in claim 1 wherein said free surface includes a recess, and said pellet includes a protuberance receivable in said recess.

* * * * *